US006572666B1

(12) United States Patent
Nettleship et al.

(10) Patent No.: US 6,572,666 B1
(45) Date of Patent: Jun. 3, 2003

(54) ABRASIVE ARTICLES AND METHODS OF MAKING THE SAME

(75) Inventors: David A. Nettleship, Litchfield (GB); Alan R. Ball, Coventry (GB); Karen E. Lambert, Elton (GB); Sandrine Maljean, Paris (FR)

(73) Assignee: 3M Innovative Properties Company, St. Paul, MN (US)

( * ) Notice: Subject to any disclaimer, the term of this patent is extended or adjusted under 35 U.S.C. 154(b) by 70 days.

(21) Appl. No.: 09/966,993

(22) Filed: Sep. 28, 2001

(51) Int. Cl.[7] ..... B24D 3/02; B24D 3/28; B24D 18/00

(52) U.S. Cl. ..... 51/298; 51/307; 51/308; 51/309; 51/295; 51/293

(58) Field of Search ..... 51/298, 307, 308, 51/309, 295, 293

(56) References Cited

U.S. PATENT DOCUMENTS

| | | | |
|---|---|---|---|
| 2,958,593 | A | 11/1960 | Hoover et al. |
| 4,314,827 | A | 2/1982 | Leitheiser et al. |
| 4,518,397 | A | 5/1985 | Leitheiser et al. |
| 4,543,107 | A | 9/1985 | Rue |
| 4,623,364 | A | 11/1986 | Cottringer et al. |
| 4,734,104 | A | 3/1988 | Broberg |
| 4,737,163 | A | 4/1988 | Larkey |
| 4,741,743 | A | 5/1988 | Narayanan et al. |
| 4,744,802 | A | 5/1988 | Schwabel |
| 4,770,671 | A | 9/1988 | Wood |
| 4,800,685 | A | 1/1989 | Haynes, Jr. |
| 4,881,951 | A | 11/1989 | Monroe et al. |
| 4,898,597 | A | 2/1990 | Hay et al. |
| 4,997,461 | A | 3/1991 | Markhoff-Matheny et al. |
| 5,011,508 | A | 4/1991 | Wald et al. |
| 5,038,453 | A | 8/1991 | Kurita et al. |
| 5,090,968 | A | 2/1992 | Pellow |
| 5,094,672 | A | 3/1992 | Giles, Jr. et al. |
| 5,110,332 | A | 5/1992 | Isaksson |
| 5,118,326 | A | 6/1992 | Lee et al. |
| 5,131,926 | A | 7/1992 | Rostoker et al. |
| 5,139,978 | A | 8/1992 | Wood |
| 5,152,917 | A | 10/1992 | Pieper et al. |
| 5,178,646 | A | 1/1993 | Barber, Jr. et al. |
| 5,201,916 | A | 4/1993 | Berg et al. |
| 5,203,884 | A | 4/1993 | Buchanan et al. |
| 5,203,886 | A | 4/1993 | Sheldon et al. |
| 5,227,104 | A | 7/1993 | Bauer |
| 5,259,147 | A | 11/1993 | Falz et al. |
| 5,282,875 | A | 2/1994 | Wood et al. |
| 5,306,319 | A | 4/1994 | Krishnan et al. |
| 5,366,523 | A | 11/1994 | Rowenhorst et al. |
| 5,378,251 | A | 1/1995 | Culler et al. |
| 5,417,726 | A | 5/1995 | Stout et al. |
| 5,429,647 | A | 7/1995 | Larmie |
| 5,436,063 | A | 7/1995 | Follett et al. |
| 5,478,908 | A | 12/1995 | Hesse et al. |
| 5,496,386 | A | 3/1996 | Broberg et al. |
| 5,498,269 | A | 3/1996 | Larmie |
| 5,520,711 | A | 5/1996 | Helmin |
| 5,551,963 | A | 9/1996 | Larmie |
| 5,593,467 | A | 1/1997 | Monroe |
| 5,609,706 | A | 3/1997 | Benedict et al. |
| 5,665,127 | A | 9/1997 | Moltgen et al. |
| 5,738,696 | A | 4/1998 | Wu |
| 5,863,308 | A | 1/1999 | Qi et al. |
| 5,954,844 | A | 9/1999 | Law et al. |
| 5,961,674 | A | 10/1999 | Gagliardi et al. |
| 5,975,988 | A | 11/1999 | Christianson |
| 5,980,597 | A | 11/1999 | Loughlin |

*Primary Examiner*—Michael Marcheschi
(74) *Attorney, Agent, or Firm*—Gregory D. Allen

(57) ABSTRACT

Abrasive articles comprising abrasive particles and at least one of (a) a reaction product of components comprising a resole phenolic resin and a bisphenol/fornaldehyde resin, (b) a bond system is derived by curing a mixture of a resole phenolic resin and a bisphenol/formaldehyde resin, and/or (c) a bond system comprising polymeric material preparable by combining components comprising a resole phenolic resin and a bisphenol/formaldehyde resin.

34 Claims, No Drawings

ABRASIVE ARTICLES AND METHODS OF MAKING THE SAME

FIELD OF THE INVENTION

This invention relates to methods of making abrasive articles in which abrasive particles are bonded to a substrate by a binder. In particular the invention relates to methods of making coated abrasive and nonwoven, fibrous abrasive articles.

RELATED ART

Conventional coated abrasive articles have an abrasive layer of abrasive particles and binder attached to a backing material. In one common form the abrasive layer includes make and size layers of binder. Such coated abrasive articles are typically made by applying a the make layer (e.g., a resin) onto a major surface of the backing material, at least partially embedding abrasive particles into the make layer, at least partially solidifying (e.g., curing) the make layer, applying the size layer (e.g., a resin) over the abrasive particles and make layer, and solidifying (e.g., curing) the size layer. One function of the size layer is to improve the retention of the abrasive particles to the backing material.

Coated abrasive articles optionally further include other layers known in the art, including presize, backsize, tie, and supersize layers Functions of additional layers include providing a grinding aid, lubricant, or antistat.

Conventional nonwoven abrasive articles are typically made of nonwoven webs constituted of a network of synthetic fibers or filaments which provide surfaces upon which abrasive particles are adhesively attached by a binder.

Nonwoven abrasive articles have employed a "make" coat of resinous binder material in order to secure the abrasive particles to the fiber or filament surface backing as the particles are oriented on the backing or throughout the lofty fibrous mat. A "size" coat of resinous binder material also has been applied over the make coat and abrasive grains in order to anchor and reinforce the bond of the abrasive particles to the backing or fibrous mat. A conventional sequence of fabrication steps for making nonwoven abrasive articles involves: first applying the make coat and abrasive particles to the backing or lofty fibrous mats; partially curing the make coat; applying the size coat; and finally, the make and size coats are fully cured.

In another known process for the production of nonwoven abrasive articles a pre-bond coat is applied to the fibrous mat followed by a make coat which contains abrasive particles. The pre-bond coat may be applied by roll coating and the make coat by spraying each side of the web.

Binder resin used to make the abrasive articles are frequently the same or similar to avoid compatibility problems potentially associated with the use of dissimilar resins. Exemplary details regarding binders for abrasive articles can be found, for example, in U.S. Pat. No. 5,980,597 (Loughlin) and U.S. Pat. No. 5,478,908 (Hesse et al.). Thermally curable binders are one type of resin that has been used to make coated abrasives and nonwoven fibrous abrasive articles as they tend to provide abrasive articles having excellent properties (e.g., enhanced heat resistance). Conventional thermally curable resins include phenolic resins, urea formaldehyde resins, urethane resins, melamine resins, epoxy resins, and alkyd resins. Among these, phenolic resins have been used extensively to manufacture abrasive articles because of their thermal properties, availability, low costs and ease of handling. To render the resin precursors coatable, obtain the proper coating viscosities, and obtain defect free coatings, solvents are commonly added to the uncured resins.

There are two basic types of conventional phenolic resins: resole and novolac phenolic resins. Novolac phenolic resins are characterized by being acid catalyzed and having a ratio of formaldehyde to phenol of less than one, typically between 0.5:1 to 0.8:. Acidic catalysts suitable for novolac phenolic resins include sulfuric, hydrochloric, phosphoric, oxalic, and p-toluene sulfonic acids. Novolac phenolic are thermoplastic resins and in the cured form are brittle solids. Novolac phenolic resins are typically reacted with other chemicals to form a crosslinked solid. Resole phenolic resins are characterized by being alkaline catalyzed and having a ratio of formaldehyde to phenol of greater than or equal to one, typically from 1:1 to 3:1. Alkaline catalysts suitable for resole phenolic resins include sodium hydroxide, barium hydroxide, potassium hydroxide, calcium hydroxide, organic amines, or sodium carbonate. Resole phenolic resins are thermosetting resins and in the cured form exhibit excellent toughness, dimensional stability, high strength, hardness, and heat resistance.

In formulating the phenolic resins, the monomers currently used in greatest volume are phenol and formaldehyde. Other noteworthy starting materials are the alkyl-substituted phenols, including cresols, xylenols, p-tert-butyl-phenol, p-phenylphenol and nonylphenol. Diphenols e.g. resorcinol (1,3-benzenediol and bisphenol-A (bis-A or 2,2-bis(4-hydroxyphenyl)propane) are employed in smaller quantities for applications requiring special properties.

In the production of adhesive coatings for nonwoven abrasive articles, one standard starting phenolic resin composition is a 70% solids condensate of a 1.96:1.0 formaldehyde: phenol mixture with 2% potassium hydroxide catalyst added based on the weight of phenol. The phenolic component of the phenolic resin is typically solid and requires the addition of solvent to render it soluble to react with the formaldehyde. The phenolic resin composition is typically 25 to 28% by weight water and 3 to 5% by weight propylene glycol ether to reduce the viscosity of the resin. Before this resin is used as a make or size coat, (i.e. to make it coatable), further viscosity reduction is often achieved using VOC (i.e. a volatile organic compound). A conventional phenolic resin make coat may contain up to 40% by weight of a VOC, such as isopropyl alcohol to reduce viscosity and make the phenolic compatible with resin modifiers (flexibilizers), while a size coat might contain up to 20% % by weight of a VOC, such as diethylene glycol ethyl ether. Unreacted phenol and formaldehyde in the final, cured resin also contribute to VOC.

To reduce emissions of VOC, progress has been made to modify suitable resin systems to replace organic solvents with water (see, e.g., U.S. Pat. No. 5,178,646 (Barber et al.) and U.S. Pat. No. 5,306,319 (Krishnan et al.)).

Although bisphenol/formaldehyde resin systems may have acceptable VOC levels, the use of these resins as make, size and pre-bond coats in abrasive articles does not provide abrasive articles having performance characteristics equivalent to abrasive articles having make, size and pre-bond coats of phenol/formaldehyde resins, particularly when coarse abrasive particles are used.

SUMMARY OF THE INVENTION

In one aspect, the present invention an abrasive article (e.g., a coated abrasive article or a nonwoven abrasive article) comprising abrasive particles bonded to a substrate by a bond system, wherein at least a portion of the bond system comprises a reaction product of components comprising a resole phenolic resin and a bisphenol/formaldehyde resin.

In another aspect, the present invention comprises an abrasive article comprising abrasive particles bonded to a substrate by a bond system, wherein at least a portion of the bond system is derived by curing a mixture of a resole phenolic resin and a bisphenol/formaldehyde resin.

In yet another aspect, the abrasive article comprises abrasive particles bonded to a substrate by a bond system wherein at least a portion of the bond system comprises polymeric material preparable by combining components comprising a resole phenolic resin and a bisphenol/formaldehyde resin.

In some embodiments of the present invention, the abrasive article is a coated abrasive comprising a backing material, a make coat having abrasive grains therein, and a size coat over the abrasive grains, wherein at least one of the make coat or size coat comprises the bond system. In other embodiments of the present invention, the abrasive article is a nonwoven abrasive article comprising a nonwoven web constituted of a network of synthetic fibers of filaments which provide surfaces on which abrasive particles are attached thereto by the bond system.

In another aspect, the present invention provides methods for making the abrasive articles. For example, one method comprises' applying a curable bond system (see, e.g., descriptions above) and abrasive particles to a substrate; and curing the bond system. Further, for coated abrasive articles, for example, the method comprises applying a make coat to a major surface of a backing material, at least partially embedding abrasive particles to the make coat, and applying a size coat over the abrasive particles, wherein at least one of (preferably, both) the make coat or size coat is prepared, or is preparable, by mixing components comprising a resole phenolic resin and a bisphenol/formaldehyde resin.

For making nonwoven abrasive articles, for example, the method can comprise applying a make coat and abrasive particles to the nonwoven web, and applying a size coat over the abrasive make coat and abrasive particles, wherein at least one of (preferably, both) the make coat or size coat is prepared, or is preparable, by mixing components comprising a resole phenolic resin and a bisphenol/formaldehyde resin.

According to the present invention there is provided a method of forming an abrasive article comprising applying a curable bond system and abrasive particles to a substrate and curing the bond system wherein at least a portion of the bond system is derived from a mixture of a resole phenolic resin and a bisphenol/formaldehyde resin.

Also according to the invention there is provided the resole phenolic resin and bisphenol/formaldehyde resin are mixed as aqueous alkaline dispersions.

Surprisingly, it has been found that the mixture of a resole phenolic resin and a bisphenol/formaldehyde resin (hereinafter BisP) provides low emission coating formulations while maintaining the performance level associated with the use of a resole phenolic resin. Furthermore, the reduction in emission from the coated mixture compared with the use of the resole phenolic resin alone is significantly more than would be expected based upon the emissions of the resole phenolic resin and BisP resin. It appears that the two resins interact positively for lower emissions with the BisP resin reducing the phenol emission and acting as a formaldehyde scavenger.

DESCRIPTION OF PREFERRED EMBODIMENTS

The resole phenolic resins used in the invention comprise phenol and formaldehyde. The molar ratio of formaldehyde to phenol is greater or equal to 1, typically in the range 1:1 to 3:1. The reaction between the formaldehyde and phenol components is catalyzed by alkaline catalysts such as sodium hydroxide, barium hydroxide, potassium hydroxide, calcium hydroxide, organic amines and sodium carbonate. The coating formulations are generally preferred as aqueous dispersion e.g. 30 to 95% solids, preferably 60 to 80% solids) with the catalyst dissolved in the water. Typically the coating formulations comprise 2% by weight of catalyst.

The BisP resin is derived from a compound having the formula:

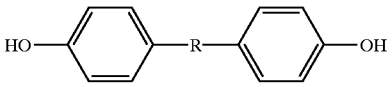

in which:

R represents a substituted or unsubstituted alkyl group, particularly a group having from 1 to 6 carbon atoms. The most frequently encountered examples of such bisphenols are bisphenol F wherein the R group is —$CH_2$—; and bisphenol A wherein the R group is $C(CH_3)_2$—

The preferred bisphenol components used to make the binders for the process of the invention have formulae in which the group R has form 1 to 4 carbon atoms and is most preferably unsubstituted.

These bisphenols react with formaldehyde in a base catalyzed reaction in the same way as phenol except for the presence of two phenolic hydroxyl groups on the molecule rather than one. The BisP resins are compatible with phenol/formaldehyde resins.

Suitable BisP resins are available from Oxychem and bear the CAS number 25085-75-0. The resin formulation generally comprises from 70 to 75% solids of the resin (measured after standing at 135° C. for three hours) in an aqueous medium and have a viscosity at 25° C. of 1100 to 1300 cP.

Another suitable resin is commercially available under the trade designation "BAKELITE 9353SW" and is available at 57% solids.

The phenolic group/formaldehyde ratios of the BisP are generally equivalent to those used in conventional phenol/formaldehyde resins. Also the useful amount of base catalyst (usually an alkali metal hydroxide) is calculated on an equivalent basis to that used in phenol/formaldehyde resins. The curing proceeds by the same route an at roughly the same temperatures that are conventional for phenol/formaldehyde resins.

The resin mixture used in the invention generally comprises from 30 to 80% by weight solids of resole phenolic resin and from 20 to 70% by weight solids of BisP resin. The precise ratio will depend upon the type of abrasive product and whether the resin mixture is used as a make or size coat etc. For coated abrasive products the resin mixture preferably comprises from 55 to 70% weight solids, more preferably 65 to 70% resole phenolic resin and correspondingly from 30 to 45% weight solids, more preferably 30 to 35% weight solids BisP. Suitable resin mixtures for the production of lofty nonwoven abrasive articles may comprise from 40 to 60%, preferably about 50% by weight solids of resole phenolic resin and correspondingly from 60 to 40%, preferably about 50% by weight solid of BisP.

In addition to the alkaline catalysts the coating formulations of the resin mixture may comprise other ingredients known in the art including solvents, plasticisers, fillers, fibers, lubricants, grinding aids, wetting agents, surfactants, pigments, dyes, coupling agent, suspending agent and reactive diluents. Preferably the resin mixture is used in both the size and make coats.

The construction and general methods of making coated abrasives are well known in the art and may be used in the subject invention since the resin mixture is compatible with the known phenolic resin systems used in the art. Thus, the selection of backing material, abrasive particles, use of primer coats, supersize coats and additives used in known coated abrasives are all envisaged for use in the subject invention. Examples of suitable abrasive particles include fused aluminum oxide (including white fused alumina, heat-treated aluminum oxide and brown aluminum oxide), silicon carbide, boron carbide, titanium carbide, diamond, cubic boron nitride, garnet, fused alumina-zirconia, and sol-gel-derived abrasive particles, and the like. The sol-gel-derived abrasive particles may be seeded or non-seeded. Likewise, the sol-gel-derived abrasive particles may be randomly shaped or have a shape associated with them, such as a rod or a triangle. Examples of sol gel abrasive particles include those described U.S. Pat. No. 4,314,827 (Leitheiser et al.), U.S. Pat. No. 4,518,397 (Leitheiser et al.), U.S. Pat. No. 4,623,364 (Cottringer et al.), U.S. Pat. No. 4,744,802 (Schwabel), U.S. Pat. No. 4,770,671 (Monroe et al.), U.S. Pat. No. 4,881,951 (Wood et al.), U.S. Pat. No. 5,011,508 (Wald et al.), U.S. Pat. No. 5,090,968 (Pellow), U.S. Pat. No. 5,139,978 (Wood), U.S. Pat. No. 5,201,916 (Berg et al.), U.S. Pat. No. 5,227,104 (Bauer), U.S. Pat. No. 5,366,523 (Rowenhorst et al.), U.S. Pat. No. 5,429,647 (Larmie), U.S. Pat. No. 5,498,269 (Larmie), and U.S. Pat. No. 5,551,963 (Larmie), the disclosures of which are incorporated herein by reference. Additional details concerning sintered alumina abrasive particles made by using alumina powders as a raw material source can also be found, for example, in U.S. Pat. No. 5,259,147 (Falz), U.S. Pat. No. 5,593,467 (Monroe), and U.S. Pat. No. 5,665,127 (Moltgen), the disclosures of which are incorporated herein by reference. In some instances, blends of abrasive particles may result in an abrasive article that exhibits improved grinding performance in comparison with abrasive articles comprising 100% of either type of abrasive particle Further details regarding coated abrasive products can be found, for example, in U.S. Pat. No. 4,734,104 (Broberg), U.S. Pat. No. 4,737,163 (Larkey), U.S. Pat. No. 5,203,884 (Buchanan et al.), U.S. Pat. No. 5,152,917 (Pieper et al.), U.S. Pat. No. 5,378,251 (Culler et al.), U.S. Pat. No. 5,417,726 (Stout et al.), U.S. Pat. No. 5,436,063 (Follett et al.), U.S. Pat. No. 5,496,386 (Broberg et al.), U.S. Pat. No. 5, 609,706 (Benedict et al.), U.S. Pat. No. 5,520,711 (Helmin), U.S. Pat. No. 5,954,844 (Law et al.), U.S. Pat. No. 5,961,674 (Gagliardi et al.), and U.S. Pat. No. 5,975,988 (Christinason), the disclosures of which are incorporated herein by reference. Further details regarding bonded abrasive products can be found, for example, in U.S. Pat. No. 4,543,107 (Rue), U.S. Pat. No. 4,741,743 (Narayanan et al.), U.S. Pat. No. 4,800,685 (Haynes et al.), U.S. Pat. No. 4,898,597 (Hay et al.), U.S. Pat. No. 4,997,461 (Markhoff-Matheny et al.), U.S. Pat. No. 5,038,453 (Narayanan et al.), U.S. Pat. No. 5,110,332 (Narayanan et al.), and U.S. Pat. No. 5,863,308 (Qi et al.), the disclosures of which are incorporated herein by reference. Further, details regarding vitreous bonded abrasives can be found, for example, in U.S. Pat. No. 4,543,107 (Rue), U.S. Pat. No. 4,898,597 (Hay), U.S. Pat. No. 4,997,461 (Markhoff-Matheny et al.), U.S. Pat. No. 5,094,672 (Giles et al.), U.S. Pat. No. 5,118,326 (Sheldon et al.), U.S. Pat. No. 5,131,926 (Sheldon al.), U.S. Pat. No. 5,203,886 (Sheldon et al.), U.S. Pat. No. 5,282,875 (Wood et al.), U.S. Pat. No. 5,738,696 (Wu et al.), and U.S. Pat. No. 5,863,308 (Qi), the disclosures of which are incorporated details regarding nonwoven abrasive products can be found, for example, in U.S. Pat. No. 2,958,593 (Hoover et al.), the disclosure of which is incorporated herein by reference.

The method of making a nonwoven abrasive article according to the present invention may comprise, for example, applying a pre-bond coat to said nonwoven web and thereafter applying a make coat and abrasive particles. Preferably, the blend is used in the make and size coats or the pre-bond and make coats of the nonwoven abrasive article.

The resin mixtures are compatible with the existing bonding systems used in the production of nonwoven abrasive articles and the known construction, ingredients and processes are for making these abrasive articles may be employed in accordance with the subject invention. Examples of such processes are disclosed in U.S. Pat. No. 2,958,593 (Hoover et al.) and U.S. Pat. No. 5,178,646, (Barber et al.), the disclosures of which are herein incorporated by reference.

This invention is further illustrated by the following examples, but the particular materials and amounts thereof recited in these examples, as well as other conditions and details, should not be construed to unduly limit this invention. Various modifications and alterations of the invention will become apparent to those skilled in the art. All parts and percentages are by weight unless otherwise indicated.

In the following Examples:

Resole A: 75% by weight solids aqueous dispersion of resole phenolic resin with a formaldehyde/phenol ratio of approximately 2.0/1 and a pH of about 8.7 and a viscosity of about 2100 cP at 25° C. as measured using a Brookfield RV viscometer available from Georgia-Pacific Resins, Inc. Columbus, Ohio.

Resole B: 75% by weight solids aqueous dispersion of resole phenolic resin with a formaldehyde/phenol ratio of approximately 2.0/1 and a pH of 8.5 and a viscosity of about 1900 cP at 25° C. as measured using a Brookfield RV viscometer, being of lower catalyst content than Resole A, available from Georgia-Pacific Resins, Inc. Columbus, Ohio.

Resole C: 71% by weight solids aqueous dispersion of resole phenolic resin with a formaldehyde/phenol ratio of approximately 2.0/1, a pH of about 8.5 and a viscosity of about 1400 cP at 25° C. as measured using a Brookfield RV viscometer, having higher molecular weight than either Resole A and B and containing about 5% by weight of urea, available from Georgia-Pacific Resins, Inc., Columbus, Ohio.

BisP: 57% aqueous dispersion of bisphenol/formaldehyde resin commercially available under the trade designation "BAKELITE SW9353", available from Bakelite AG, Iserlohn, Germany.

Emulan A: an ethoxylated oleic acid surfactant, available from BASF Corp., Ludwigshafen, Germany Irgastat: a liquid polyethylene glycolester surfactant, available from Ciba-Geigy Corp., Hawthorne, N.Y.

Iron oxide dispersion: a 50% by weight solids aqueous dispersion of iron oxide pigment, available from Penn Color, Inc., Doylestown, Pa.

Bordeau Dye: an aqueous dispersion comprising, by weight, 23% isopropanol, 10% red pigment, 2% by pigment ("NIGROSINE"), 10% water and 55% Resole C, available from Wilson Color Co., Neshamic Station, N.J.

Calcium carbonate: a filler, available from ECC International, Sylacauga, Ala.

Titanium dioxide: a filler, available from Kemira Pigments, Inc., Oklahoma City, Okla.

EXAMPLE 1 AND COMPARATIVE EXAMPLE A AND B

Size coatings were made on an abrasive sheet comprising a 250 g/m$^2$ paper backing bearing a phenol/formaldehyde make layer and P180 alumina mineral particles with a mineral coat weight of 142 g/m$^2$. The size formulations were roll coated over the mineral particles to provide a dry coat weight of 68 g/m$^2$.

The formulation for Comparative Example A was:

| | wt. % |
|---|---|
| Resole B | 79.76 |
| Calcium carbonate | 15.39 |
| Iron oxide dispersion | 4.62 |
| Irgastat wetting agent | 0.23 |
| Diluted with water to a viscosity of 200 cP at 40° C. | |

The size formulation for Example 1 was the same as for Comparative Example A, except the Resole B resin was replaced with a 60/40 blend of Resole B and BisP (Blend proportions given as a wet weight ratio).

The size formulation for Comparative Example B was the same as for Comparative Example A, except the Resole B was replaced with BisP.

The coated abrasive sheets were cured at 103° C.

Samples of the coated sheets were cut into discs and mounted on a rotary sanding machine. Oak sticks were plunged into the abrasive surface with a pressure of 7 N/cm$^2$ or 10 N/cm$^2$ to abrade the oak test pieces in the direction of the grain. The cut performance was measured:

| Example | cut/g @7N/cm$^2$ | cut/g @10N/cm$^2$ |
|---|---|---|
| Comp. A | 34.9 | 23.8 |
| 1 | 33.3 | 24.8 |
| Comp. B | (*) | (*) |

*The test discs Comparative B burn loaded, ending the test prematurely. Example 1 accordance with the present invention performed as well as Comparative Example A, which is a standard size coat used on commercial coated abrasive products.

EXAMPLE 2 AND COMPARATIVE EXAMPLES C AND D

P180 and 60 grade alpha alumina-based sol-gel derived abrasive particles (marketed under the trade designation "CUBITRON" from the 3M Company, St. Paul, Minn.) coated abrasive articles having 110 and 175 g/m$^2$ mineral coat weight respectively were prepared using a make coat comprising Resole B.

The following size formulations were prepared and roll coated and cured at 105° C.

| Constituents | Comparative Example C Wt. % | Comparative Example D wt. % |
|---|---|---|
| Resole B | 70.15 | 74.35 |
| Emulan A | 0.10 | 0.1 |
| Calcium Carbonate | 14.00 | 14.90 |
| Titanium Dioxide | 3.50 | 3.70 |
| Color | 0.75 | 0.75 |
| Water | 11.5 | 6.20 |
| Dilute at 40° C. to | 100 cP | 230 cP |
| Coated paper | P180 | P60 |
| Solids coat weight | 67g/m$^2$ | 118 g/m$^2$ |

EXAMPLE 2(a)

Prepared as described for Comparative Example C, wherein the Resole B was replaced with, in the same resin solids/filler solids ratio, of a blend of Resole B and BisP in wet weight ratio 60/40 Likewise, the solids coating weight was 67 g/m$^2$.

EXAMPLE 2(b)

Prepared as described for Comparative Example D, wherein the Resole B was replaced with, in the same resin solids/filler solids ratio, of a blend of Resole B and BisP in wet weight ratio 60/40. Likewise, the solids coating weight was 118 g/m$^2$.

EXAMPLE 2(c)

Prepared as described for As per Example 2(a), wherein the Resole B in the resole/BisP blend was replaced with an equal quantity of Resole A.

EXAMPLE 2(d)

Prepared as described for Example 2(b), wherein the Resole B in the resole/BisP blend was replaced with an equal quantity of Resole A.

EXAMPLE 2(e)

Prepared as described for Example 2(a), wherein 5% by weight of urea, based on the weight of Resole B, was added. This mix was coated at a weight that provided the same solids coat weights.

EXAMPLE 2(f)

Prepared as described for Example 2(b), wherein 5% by weight of urea, based on the weight of Resole B, was added. This mix was coated at a weight that provided the same solids coat weights.

The coated abrasives were tested as in Example 1 at a pressure of 7 N/cm$^2$.

Cut Performance of P180

| Example | Cut/g |
|---|---|
| Comp C | 0.61 |
| 2(a) | 0.70 |
| 2(c) | 0.66 |
| 2(e) | 0.63 |

Cut Performance of P60

| Example | Cut/g |
|---|---|
| Comp. D | 0.80 |
| 2(d) | 0.73 |
| 2(f) | 0.77 |

EXAMPLE 3

The following make formulations were prepared:

EXAMPLE 3(a)

| | |
|---|---|
| Resole A | 6000 g |
| BisP | 4000 g |
| Emulan A | 10 g |
| Water dilute to 350 cP at 40° C. | |

EXAMPLE 3(b)

| | |
|---|---|
| Resole B | 6000 g |
| BisP | 4000 g |
| Urea | 300 g |
| Water dilute to 350 cP at 40° C. | |

EXAMPLE 3(c)

| | |
|---|---|
| Resole B | 6000 g |
| BisP | 4000 g |
| Urea | 300 g |
| Water dilute to 700 cP at 40° C. | |

Coated abrasive sheets were prepared as in Example 2 substituting Example 3(a) and 3(b) as the make coat. The make coat weight for P180 grade was 28 g/m$^2$ and for P60 grade was 50 g/m$^2$. Example 3(c) was used as the make coat on the P60.

Example 2(a) was applied as a size coat on the P180 grade and Example 2(b) was applied as a size coat on the P60 grade as in Example 2. Disc cut tests were performed as in Example 2.

| Grade | Make coat | Cut/g |
|---|---|---|
| P180 | 3(a) | 0.63 |
| P180 | 3(b) | 0.68 |
| P60 | 3(c) | 0.89 |

The performance matched the performance of equivalent abrasive discs using Resole A and Resole B as make and size coats.

EXAMPLE 4

Emission Measurement

Analytical estimates of emissions were determined by headspace gas chromatography in combination with mass spectrometry (GCMS). The GCMS analysis allows a semi quantitative comparison of the emissions of different formulations.

The GCMS tests were conducted following the cure temperature profile of the ovens used in the manufacture of coated abrasives. A series of snap shots of the relative emissions was taken once the headspace has reached the maximum temperature.

15 minutes 70° C.

23 minutes at 90° C.

20 minutes at 103° C. Sample

Flush after 60 minutes

Sample at 80 minutes

Flush at 100 minutes

Sample at 140 minutes

The majority of emissions that are produced during the cure of phenol/formaldehyde resins are phenol and formaldehyde. By summing the total emission observed during the cure regime described above the relative emission behaviour of formulations may be compared.

The table below shows how addition of BisP cuts the emissions of Resole A. Emission values shown represent the integrated area under the relevant GC peak.

| Resin sample | Formaldehyde | Formaldehyde emission reduction/% | Phenol | Phenol emission reduction/% |
|---|---|---|---|---|
| Resole A | 178 | 0 | 487 | 0 |
| Resole A + 15% BisP | 160 | 10 | 431 | 12 |
| Resole A + 30% BisP | 81 | 55 | 351 | 28 |
| Resole A + 30% BisP + 3% urea | 11 | 94 | | |

Emission tests of blends containing urea indicate that this may be used to further reduce the emissions of formaldehyde.

Comparisons of formaldehyde emission values indicate that in addition to acting to average down phenol emissions as previously indicated. BisP appears to act as a formaldehyde scavenger. Less formaldehyde is emitted than would have been predicted by weight averaging of the emissions of the separate resins.

Emission tests were conducted on formulations based on Formulation 4 using Resole B, BisP and different blends of Resole B and BisP. Formaldehyde emissions for the blends were predicted based upon the emissions of Resole B and BisP. The results are reported in the following Table.

| | Formaldehyde Emissions | | |
|---|---|---|---|
| Resin Content | Prediction | Actual | Positive Interaction % |
| Resole B | | 299 | |
| BisP | | 16 | |
| Blend 70/30 Resole B/BisP | 219 | 143 | 35 |
| Blend 50/50 Resole B/BisP | 158 | 89 | 44 |
| Blend 30/70 Resole B/BisP | 90 | 38 | 58 |

EXAMPLE 5

Emission Testing

Using the technique of Fourrier Transform Infra Red Spectroscopy, emissions of size coating formulations were measured during a production run of P80 grade alumina sandpaper. This allowed a continuous quantitative determination of factory emissions as the coating cured.

The size formulations used were:

COMPARATIVE EXAMPLE E

| | wt. % |
|---|---|
| Resole B | 53.82 |
| Calcium carbonate filler | 40.92 |
| Iron oxide dispersion | 5.01 |
| Irgastat | 0.25 |
| Diluted to viscosity | 500 cP at 40° C. |

EXAMPLE 5

Prepared as described for Comparative Example E, using a 60/40 blend of Resole B and BisP (Blend preparation given as wet weight ratio). Emission rates were determined over a 10 minute period at 90° C., a section of the abrasive product cure cycle.

| Comparative Example E | | Example 5 | | | |
|---|---|---|---|---|---|
| Formaldehyde kg/hour | Phenol Kg/hour | Formaldehyde Kg/hour | Reduction % | Phenol Kg/hour | Reduction % |
| 0.51 | 0.76 | 0.26 | 48.4 | 0.55 | 28.2 |

Emissions were reduced on substituting Resole B with a blend of Resole B and BisP in a 60/40 wet weight ratio.

Abrasive tests of the sandpaper as described in Example 2.

| | Comparative Example E | Example 5 |
|---|---|---|
| Cut/g | 0.69 | 0.71 |

The results confirm high abrasive performance is maintained.

EXAMPLE 6

Factory tests were conducted for the production of the product AVFHP (a very fine hand pad) commercially available from the 3M company, St. Paul, Minn. The product comprises a lofty nonwoven web of synthetic film having abrasive particles bonded to the surface of the films by a bond system.

The nonwoven web used was 6.6 nylon fibre (20 dtex size) from Rhodia Fibres (Germany) at a weight of 130 g/m$^2$.

A pre-bond coating was applied to the web by roll coating at a coating weight of 185 g/m$^2$ (wet coating weight) and the coating cured at 170° C. for 100 seconds.

A make coating in the form of a spray was applied by a spray coater to one side of the web (at a wet coating weight of 230 g/m$^2$), dried and cured at 170° C. for 100 seconds.

A make coating in the form of a spray was applied by a spray coater to the other side of the web (at wet coating weight of 230 g/m$^2$), dried and cured at 170° C. for 100 seconds.

Thereafter the coated web was cured at 160° C. for 50 seconds.

The following coating formulations were used:

Roll Coat Formulations

COMPARATIVE EXAMPLE F

| | |
|---|---|
| Resole C | 58% |
| Polyethylene glycol 400 | 13% |
| Antifoam (Rhodorsip 416) | 0.15% |
| Bordeau Dye | 5% |
| Water | ~24% |

EXAMPLE 6(a)

Prepared as described for Comparative Example F, replacing Resole C with a 50/50 blend of Resole C and BisP (blend proportions given as a wet weight value).

Spray Coat Formulations

COMPARATIVE EXAMPLE G

| | |
|---|---|
| Resole C | 20% |
| Bordeau Dye | 0.4% |
| NaOH solution (30%) 2% | |
| Calcium carbonate | 4% |
| Iron oxide abrasive | 57% |
| (average particle size is 50 to 100 micrometers at 50%) | |
| Water | ~17% |

EXAMPLE 6(b)

Prepared as described for Comparative Example F, replacing Resole C with a 50/50 blend of Resole C and BisP (blend proportions given as a wet weight ratio).

Example 6(c) using Comparative Examples F and G was prepared and its performance and emissions compared with Example 6(d) using Examples 6(a) and 6(b) in accordance with the present invention.

| Mass emission in Kg/hour | Phenol | Formaldehyde | Total |
|---|---|---|---|
| 6(c)) | 1.8 | 3.1 | 4.9 |
| 6(d) | 1.0 | 1.9 | 2.9 |
| % reduction | 46 | 38 | 41 |

Various modifications and alterations of this invention will become apparent to those skilled in the art without departing from the scope and spirit of this invention, and it should be understood that this invention is not to be unduly limited to the illustrative embodiments set forth herein.

What is claimed is:

1. A method of making an abrasive article comprising:

applying a curable bond system and abrasive particles to a substrate; and curing the bond system, wherein at least a portion of the bond system is derived from a mixture of at least a resole phenolic resin and a bisphenol/formaldehyde resin.

2. A method according to claim 1 wherein the abrasive article is a coated abrasive, and wherein the method comprises:

applying a make coat to a major surface of a backing material;

at least partially embedding abrasive particles to the make coat; and applying a size coat over the abrasive particles, wherein at least one of the make coat or size coat comprises said mixture of at least a resole phenolic resin and a bisphenol/formaldehyde resin.

3. A method according to claim 2 wherein the size coat and make coat comprise said mixture of at least a resole phenolic resin and a bisphenol/formaldehyde resin.

4. A method according to claim 3 wherein said mixture comprises from 55 to 70% by weight solids of resole phenolic resin and from 30 to 40% by weight solids of bisphenol/formaldehyde resin.

5. A method according to claim 4 wherein the bisphenol/formaldehyde resin is produced using bisphenol A.

6. A method according to claim 4 wherein the resole phenolic resin and bisphenol formaldehyde resin are mixed as aqueous alkaline dispersions.

7. A method according to claim 4 wherein the mixture additionally comprises up to 10% by weight solids of urea.

8. A method according to claim 1 wherein the abrasive article is a nonwoven abrasive article comprising a nonwoven web constituted of a network of at least one of synthetic fibers or filaments which provide surfaces on which abrasive particles are attached by said bond system.

9. A method according to claim 8, wherein the method comprises:

applying a make coat and abrasive particles to said nonwoven web; and applying a size coat over the abrasive make coat and abrasive particles, wherein at least one of said make coat or size coat comprises said mixture of at least a resole phenolic resin and a bisphenol/formaldehyde resin.

10. A method according to claim 9 wherein each of the size coat and make coat comprise said mixture of at least a resole phenolic resin and a bisphenol/formaldehyde resin.

11. A method according to claim 9 wherein said mixture comprises from 40 to 60% by weight solids of resole phenol resin and from 60 to 40% by weight solids of bisphenol/formaldehyde resin.

12. A method according to claim 9 wherein the bisphenol formaldehyde resin is produced using bisphenol A.

13. A method as claimed in claim 9 wherein the resole phenol resin and bisphenol formaldehyde resin are mixed as aqueous alkaline dispersions.

14. A method according to claim 8, wherein the method comprise:

applying a pre-bond coat to said nonwoven web; and applying a make coat and abrasive particles over the pre-bond coat, wherein at least one of said pre-bond coat or make coat comprises said mixture of at least a resole phenolic resin and a bisphenol/formaldehyde resin.

15. A method according to claim 14 wherein each of the pre-bond and make coat comprises said mixture of at least a resole phenolic resin and a bisphenol/formaldehyde resin.

16. A method according to claim 14 wherein said mixture comprises from 40 to 60% by weight solids of resole phenol resin and from 60 to 40% by weight solids of bisphenol/formaldehyde resin.

17. A method according to claim 14 wherein the bisphenol/formaldehyde resin is produced using bisphenol A.

18. A method as claimed in claim 14 wherein the resole phenol resin and bisphenol formaldehyde resin are mixed as aqueous alkaline dispersions.

19. An abrasive article comprising abrasive particles bonded to a substrate by a bond system, wherein at least a portion of the bond system comprises a reaction product of components comprising a resole phenolic resin and a bisphenol/fornaldehyde resin.

20. An abrasive article according to claim 19 which is a coated abrasive comprising a backing material, a make coat having abrasive grains therein, and a size coat over the abrasive grains, wherein at least one of the make coat or size coat comprises said bond system.

21. An abrasive article according to claim 20 wherein each of the size coat and make coat comprise said bond system.

22. An abrasive article according to claim 20 wherein the bisphenol is bisphenol A.

23. An abrasive article according to claim 20 wherein said mixture additionally comprises up to 10% by weight solids of urea.

24. An abrasive article according to claim 19 wherein the abrasive article is a nonwoven abrasive article comprising a nonwoven web constituted of a network of synthetic fibers of filaments which provide surfaces on which abrasive particles are attached thereto by said bond system.

25. An abrasive article according to claim 24 comprising a make coat and abrasive particles on said nonwoven web, and a size coat over said make coat and abrasive particles, wherein at least one of said make coat or size coat comprises said bond system.

26. An abrasive article according to claim 25 wherein each of the size coat and make coat comprises said bond system.

27. An abrasive article according to claim 25 wherein said bisphenol is bisphenol A.

28. An abrasive article according to claim 24 comprising a pre-bond coat, a make coat and abrasive particles on said nonwoven web, wherein at least one of said make coat or pre-bond coat comprises said bond system.

29. An abrasive article comprising abrasive particles bonded to a substrate by a bond system, wherein at least a portion of the bond system is derived by curing a mixture of a resole phenolic resin and a bisphenol/formaldehyde resin.

30. An abrasive article according to claim 29 which is a coated abrasive comprising a backing material, a make coat having abrasive grains therein, and a size coat over the abrasive grains, wherein at least one of the make coat or size coat comprises said bond system.

31. An abrasive article according to claim 29 wherein the abrasive article is a nonwoven abrasive article comprising a nonwoven web constituted of a network of synthetic fibers of filaments which provide surfaces on which abrasive particles are attached thereto by said bond system.

32. An abrasive article comprising abrasive particles bonded to a substrate by a bond system wherein at least a portion of the bond system comprises polymeric material preparable by combining components comprising a resole phenolic resin and a bisphenol/formaldehyde resin.

33. An abrasive article according to claim 32 which is a coated abrasive comprising a backing material, a make coat having abrasive grains therein, and a size coat over the abrasive grains, wherein at least one of the make coat or size coat comprises said bond system.

34. An abrasive article according to claim 32 wherein the abrasive article is a nonwoven abrasive article comprising a nonwoven web constituted of a network of synthetic fibers of filaments which provide surfaces on which abrasive particles are attached thereto by said bond system.

* * * * *

UNITED STATES PATENT AND TRADEMARK OFFICE

CERTIFICATE OF CORRECTION

PATENT NO. : 6,572,666 B1
DATED : June 3, 2003
INVENTOR(S) : Nettleship, David A.

It is certified that error appears in the above-identified patent and that said Letters Patent is hereby corrected as shown below:

Title page,
Item [56], References Cited, U.S. PATENT DOCUMENTS,
"4,770,671 A 9/1988 Wood" should be -- 4,770,671 A 9/1988 Monroe et al. --.
"4,881,951 A 11/1989 Monroe et al." should be -- 4,881,951 A 11/1989 Wood --.
Item [57], Abstract, "fornaldehyde" should be -- formaldehyde --.

Column 1,
Line 18, delete "a" following "apply".
Line 28, insert -- . -- following "layers".

Column 2,
Line 9, "0.8:" should be -- 0.8:1 --.
Line 12, insert -- resins -- preceding "are".
Line 49, delete "%" following "%".
Line 55, "Barber et al." should be -- Barber, Jr. et al. --.
Line 66, insert -- provides -- preceding "an".

Column 3,
Line 8, insert -- article -- following "abrasive".
Line 29, delete "'" following "comprises".

Column 4,
Line 5 insert --from -- preceding "1:1".
Line 11, "dispersion e.g. 30" should be -- dispersion (e.g., 30 --.
Line 28, insert -- . -- following "-".
Line 31, "form" should be -- from --.
Line 51, "an" should be -- and --.

Column 5,
Line 27, insert -- in -- preceding "U.S."
Line 43, "Falz" should be -- Falz et al. --.
Line 44, "Moltgen" should be -- Moltgen et al. --.
Line 50, insert -- . -- following "particle".
Line 58, "5, 609,706" should be -- 5,609,706 --.
Line 61, "Christinason" should be -- Christianson --.
Line 66, "Haynes et al." should be -- Haynes, Jr. --.

Column 6,
Line 1, "Narayanan et al." should be -- Kurita et al. --.
Line 2, "Narayanan et al." should be -- Isaksson --.
Line 6, "Hay" should be -- Hay et al. --.

UNITED STATES PATENT AND TRADEMARK OFFICE

CERTIFICATE OF CORRECTION

PATENT NO. : 6,572,666 B1
DATED : June 3, 2003
INVENTOR(S) : Nettleship, David A.

It is certified that error appears in the above-identified patent and that said Letters Patent is hereby corrected as shown below:

Column 6 cont.,
Line 8, "Giles et al." should be -- Giles, Jr. et al. --.
Line 8, "Sheldon et al." should be -- Lee et al. --.
Line 9, "Sheldon al." should be -- Rostoker et al. --.
Line 11, delete "et al." following "Wu".
Line 12, insert -- et al. -- following "Qi".
Line 13, insert -- herein by reference. Further -- after "incorporated".
Line 27, delete "are" preceding "for".
Line 32, "Barber et al." should be -- Barber, Jr. et al.--.

Column 7,
Line 1, "SW9353" should be -- 9353SW --.
Line 13, delete "by" following "2%".
Line 23, "EXAMPLE" should be -- EXAMPLES --.

Column 8,
Line 7, "Minn.)coated" should read -- Minn.) were used to make coated --.
Line 33, delete "of" preceding "a".
Line 34, insert -- . -- following "60/40".
Line 40, delete "of" preceding "a".
Line 46, delete "As per" following "for".

Column 10,
Line 31, insert -- at -- preceding "70°".
Line 42, "behaviour" should be -- behavior --.
Line 65, insert -- , -- after "that".
Line 66, after "indicated" delete -- . -- and insert ",".

Column 11,
Line 4, "Formulation 4" should be -- Example 4 --.
Line 28, "Fourrier" should be -- Fourier --.
Line 49, "EXAMPLE 5" should be -- EXAMPLE 5A --.
Line 54, "a section" should be -- using a section --.

Column 12,
Line 5, "Example 5" should be -- Example 5A --.
Line 16, "company" should be -- Company --.

Column 13,
Line 14, delete ")" following ")".
Line 53, insert -- / -- following "bisphenol".

UNITED STATES PATENT AND TRADEMARK OFFICE

CERTIFICATE OF CORRECTION

PATENT NO. : 6,572,666 B1
DATED : June 3, 2003
INVENTOR(S) : Nettleship, David A.

It is certified that error appears in the above-identified patent and that said Letters Patent is hereby corrected as shown below:

Column 14,
Lines 11 and 14, insert -- / -- following "bisphenol".
Line 17, "comprise" should be -- comprises --.
Line 35, insert -- / -- following "bisphenol".
Line 41, "fornaldehyde" should be -- formaldehyde --.
Line 48, "comprise" should be -- comprises --.

Signed and Sealed this

Thirty-first Day of August, 2004

JON W. DUDAS
*Director of the United States Patent and Trademark Office*